United States Patent [19]

Follert et al.

[11] Patent Number: 4,556,256

[45] Date of Patent: Dec. 3, 1985

[54] CUTTING APPLIANCES FOR USE IN TUNNEL DRIVING OPERATIONS

[75] Inventors: Hans G. Follert, Dortmund; Herbert Rzepka, Ascheberg; Martin Schwert, Werne, all of Fed. Rep. of Germany

[73] Assignee: Gewerkschaft Eisenhutte Westfalia, Lunen, Fed. Rep. of Germany

[21] Appl. No.: 519,365

[22] Filed: Aug. 1, 1983

[30] Foreign Application Priority Data

Aug. 5, 1982 [DE] Fed. Rep. of Germany ..... 3229268

[51] Int. Cl.[4] ..... E21D 9/08

[52] U.S. Cl. ..... 299/33; 299/11; 299/17; 299/55

[58] Field of Search ..... 299/33, 81, 64, 55, 299/17; 175/324, 393

[56] References Cited

U.S. PATENT DOCUMENTS

| | | | |
|---|---|---|---|
| 1,530,768 | 3/1925 | Haag | 299/81 |
| 3,778,107 | 12/1973 | Haspert | 299/33 |
| 4,121,673 | 10/1978 | Cherrington | 299/33 |
| 4,298,230 | 11/1981 | Krabbe | 299/58 |
| 4,368,924 | 1/1983 | Nussbaumer | 299/33 |
| 4,456,305 | 6/1984 | Yoshikawa | 299/33 |

FOREIGN PATENT DOCUMENTS

| | | | |
|---|---|---|---|
| 3022673 | 12/1981 | Fed. Rep. of Germany | 299/17 |
| 429631 | 7/1967 | Switzerland | 299/33 |

*Primary Examiner*—James A. Leppink
*Assistant Examiner*—M. Goodwin
*Attorney, Agent, or Firm*—Maurice E. Gauthier

[57] ABSTRACT

In a tunnel driving apparatus, and particularly such apparatus where a work face is supported by fluid, a cutting appliance is employed which is composed of a swinging arm carrying a cutter head. The arm can range over the face to detach material therefrom with the cutter head. Means for driving the cutter head is accommodated entirely within the arm itself and a conduit or the like extends through the arm and serves optionally to remove debris by suction or to convey pressure fluid to the face to assist the cutter head.

12 Claims, 3 Drawing Figures

CUTTING APPLIANCES FOR USE IN TUNNEL DRIVING OPERATIONS

BACKGROUND TO THE INVENTION

The present invention relates to tunnel driving apparatus and, more particularly, to cutting appliances for detaching material from a tunnel working face.

It is well known to use a drive shield to create an underground excavation such as a gallery or adit referred to for convenience hereinafter simply as a tunnel. A variety of different types of drive shield can be utilized and in order to detach material from a working face of the tunnel likewise various cutting appliances are available. One such appliance is the so-called partial cut machine which has a swinging arm or jib which can be swivelled all over the face and carries a rotary cutter head at its free end. Where a tunnel is driven in loose soil or collapsible or frangible material which is essentially unstable, it is known further to support the work face with the aid of a thixotropic fluid introduced into a chamber open to the face but closed off from the rear of the tunnel with a bulkhead. The cutting appliance still serves to detach material from the work face but now a conduit or pipe laid along the outside of the cutting arm withdraws the debris material with some of the supportive fluid by suction. German patent specifications 2431512 and 2907768 describe apparatus of this type. In these known constructions, the drive for the cutter head is disposed at the rear side of the bulkhead. Getting and loading machines, however, are known in which the drive means for a cutter head is mounted inside the swinging arm carrying the head-see, for example, German patent specifications 1921093 and 2256917.

A general object of the present invention is to provide an improved cutting appliance for tunnel driving operations.

SUMMARY OF THE INVENTION

A cutting appliance constructed in accordance with the invention comprises an arm which supports a cutter head wherein drive means for the cutter head is accommodated inside the arm together with additional conduit means. The conduit means is preferably arranged at the centre of the arm to pass through the drive means as well. The conduit means serves as is known per se, to withdraw soil or debris by suction. It is also possible to pass pressure medium to the face through the conduit means to assist the cutter head is removing material from the face. The overall construction is particularly compact and neat.

The drive means can take the form of an electric motor and gearing and components thereof are made hollow to receive the conduit means. The conduit means can serve additionally to cool the drive means.

The motor and gearing of the drive means are conveniently provided with respective housings which form at least part of the cutting arm exterior.

Tunnel driving apparatus incorporating a cutting appliance constructed in accordance with the invention may further comprise a shield, continuous or otherwise, containing a bulkhead sub-dividing its exterior into a front chamber adjacent to the working face and a rear chamber communicating with the tunnel already-driven. The arm is conveniently supported by a mounting device on the bulkhead for rotation and swinging motions. The mounting device can employ a ring member which employs sealing means for maintaining sealing between the chambers and conveniently the sealing means engages on a collar of the arm or another exterior component. Pivot joints can couple the arm to the ring member while a piston and cylinder unit serves to swing the arm on these pivot joints. A drive motor supported on the ring member and meshing via a pinion with a fixed toothed wheel on the bulkhead can serve to rotate the ring member and hence the arm. To increase the range of motions of the arm, it is possible to construct the arm to move longitudinally, bodily or in part.

The invention may be understood more readily, and various other features and aspects of the invention may become apparent from consideration of the following description.

BRIEF DESCRIPTION OF DRAWINGS

An embodiment of the invention will now be described, by way of example only, with reference to the accompanying drawings wherein.

DESCRIPTION OF PREFERRED EMBODIMENTS

Figure 1:
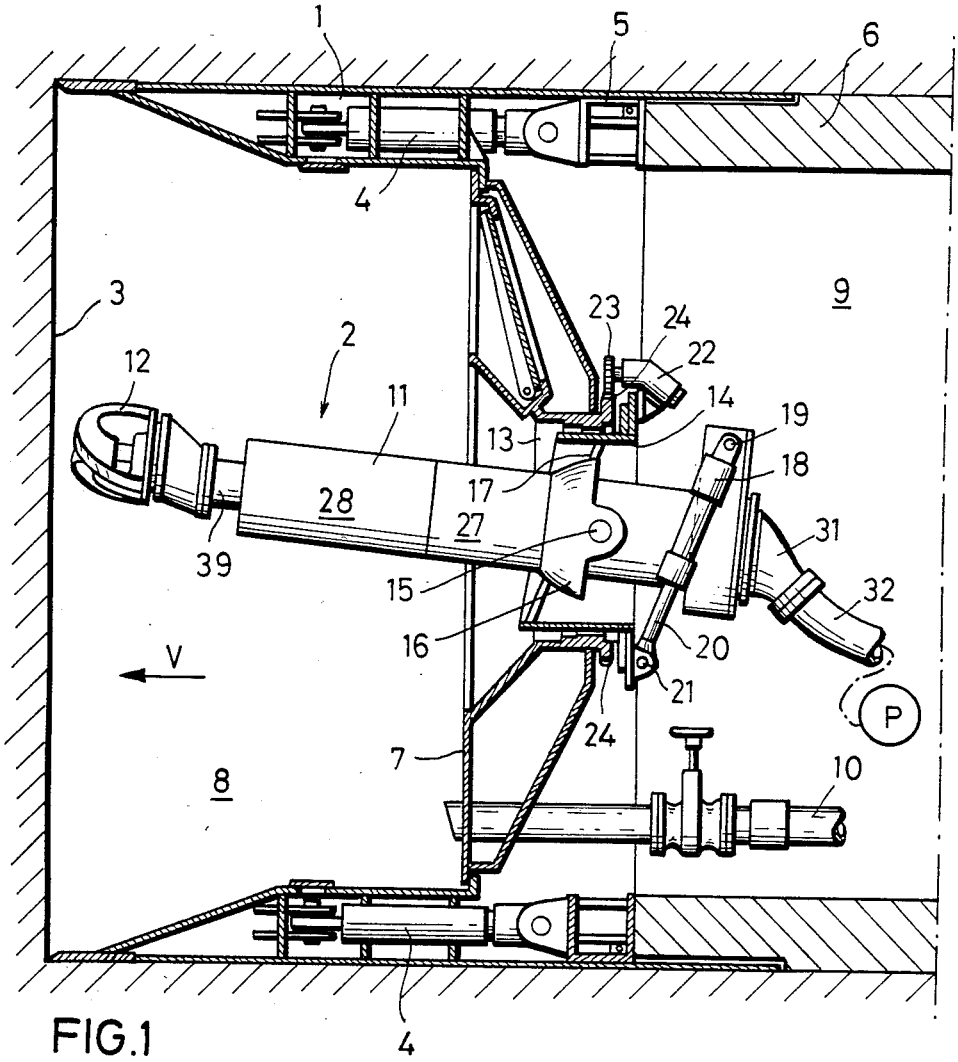
FIG. 1 is a sectional side view of apparatus constructed in accordance with the invention.

As shown in FIG. 1, apparatus constructed in accordance with the invention employs a shield 1 for supporting the exposed wall of a tunnel, in the vicinity of a working face 3. Material is detached from the face 3 with the aid of cutting means 2 located at least partly within the shield 1. The cutting means 2 can be employed with different forms of tunnelling equipment to that described. The cutting means 2 takes the form of a swinging cutting arm 11 provided with a rotary cutting head 12 equipped with one or more cutters at its outer end. The exterior shield 1 can be a knife-shield with individual cutter members carried on a frame or a continuous cylindrical or part-cylindrical cutter shoe. As represented, the shield 1 is of the latter type. The shield 1 can be advanced in the direction of arrow V with the aid of hydraulic rams 4.

The rams 4 are supported by a thrust ring 5 which abuts on the tunnel lining 6 installed at the rear of the shield 1. The lining 6 can be created in situ as is known and can take the form of concrete rings or segments.

A partition wall 7 extends across the interior of the shield 1 to form a bulkhead which creates and separates a front chamber 8 open to the working face 3 and a rear chamber 9 open to the rear 3 of the tunnel inside the lining 6. In order to support the face 3, which may be unstable and liable to collapse, the chamber 8 is filled with a thixotropic fluid such as a bentonite-water suspension under pressure. A pipe 10 extends through the wall 7 and enables the fluid to be pumped into the chamber 8.

The arm 11 is displaceably supported by a mounting structure on the bulkhead of wall 7 and this mounting structure will now be described. The wall 7 is provided with a central opening 13 to which a rotatable bearing ring 14 is mounted and sealed. The arm 11 is received in the ring 14 and is mounted for swinging up and down by means of a pivot joints 15. The pivot joints 15 comprise oppositely-located pins formed on a frusto-conical shaped collar 16 on the arm 11. A resilient seal 17 on the inside of the ring 14 engages on the exterior of the collar 16 to maintain sealing between the chambers 8,9 whether the arm 11 is swivelled or stationary. To swing the arm 11 up and down on the joints 15, an inclined hydraulic piston and cylinder unit 18 is provided at the rear side of the mounting structure. The cylinder of the unit 18 is coupled with a pivot joint 19 to a block at the rear end of the arm 11 while the piston rod of the unit 18 is coupled via a pivot joint 21 to the bearing ring 14. In order to rotate, or partly rotate, the ring 14 and hence the arm 11, drive means 22 such as a hydraulic motor is provided. The motor 22 is supported on the ring 14 and drives a pinion 23 which meshes with a fixed toothed ring 24 fitted on the wall 7.

Figure 2:
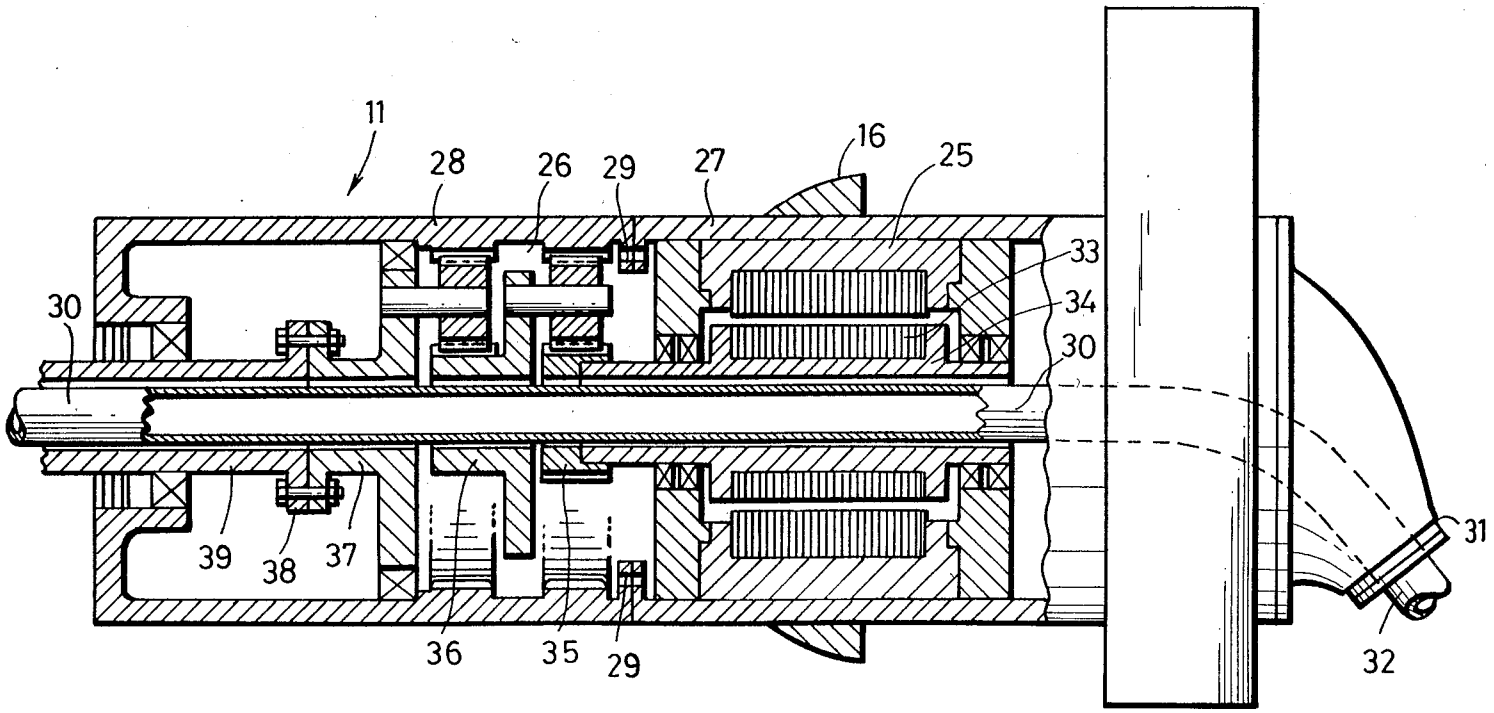
FIG. 2 is a sectional side view of part of the cutting arm of the apparatus shown in FIG. 1, the view being taken on a somewhat larger scale.

The cutting arm 11 is hollow and composed of front and rear tubular members with the drive means for the cutting head 12 accommodated inside the arm 11. As shown in FIG. 2, the drive means takes the form of an electric motor 25 and gearing 26. The motor 25 has a housing 27 which forms the rear tubular member and the gearing 26 is contained in a housing 28 which forms the front tubular member. The housings 27,28 have interengaging flanges 29 fixed together in any suitable manner. It is not essential for the housings 27,28 themselves to form the sections of the arm 11; these housings 27,28 can be located inside one or more exterior components if desired. In any event, a conduit 30 extends through the arm 11 and leads from the cutting head 12 to a connector 31 in the chamber 9. A flexible hose 32 coupled to the connector 31 leads from a pump P to the rear of the working and communicates with the conduit 30.

The gearing 26 takes the form of planetary gearing with a sunwheel 36 and planet gears meshing with teeth on the interior of the housing 28 which acts as a stationary carrier. The gearing 26 has an input drive pinion 35 and an output drive wheel 37. The wheel 37 is coupled to an output shaft 39, serving to drive the cutting head 12, via a coupling 38. The motor 25 has a stator and a rotor 33 supported on a drive shaft 34 driveably connected to the pinion 35 of the gearing 26. As shown in FIG. 2, the shaft 34, the pinion 35, the sunwheel 36, the drive wheel 37 and the shaft 39 are provided with coaxial central bores which receive the conduit 30. The conduit 30 serves to remove debris loosened from the working face 3 from the chamber 8. The debris and some of the fluid in the chamber 8 is withdrawn through the conduit 30 by pump suction and the material passes to the rear of the working for removal. In known manner, soil particles and the like can be separated from the carrier liquid and the clean liquid can be re-cycled and passed back through the pipe 40.

During operation, the arm 11 is displaced with the ram 18 and the motor 22 preferably in accordance with a pre-set program to move the cutting head 12 over the face 3. The arm 11 can, for example, move in a spiral path or in a series of lateral passes over the face 3. The face 3 is supported by the fluid in the chamber 8 and as described above, the detached material is removed through the suction conduit 30. The passage of the carrier fluid through the conduit 30 tends to cool the motor 25 and the gearing 26 internally, while the presence of the fluid in the chamber 8 cools the motor 25 and the gearing 26 from the exterior.

Since the drive for the head 12 is accommodated within the arm 11 and since the means 18,22 for displacing the arm 11 are outside the chamber 8, the working chamber 8 is not cluttered and the rear chamber 9 is reasonably clear also.

Figure 3:
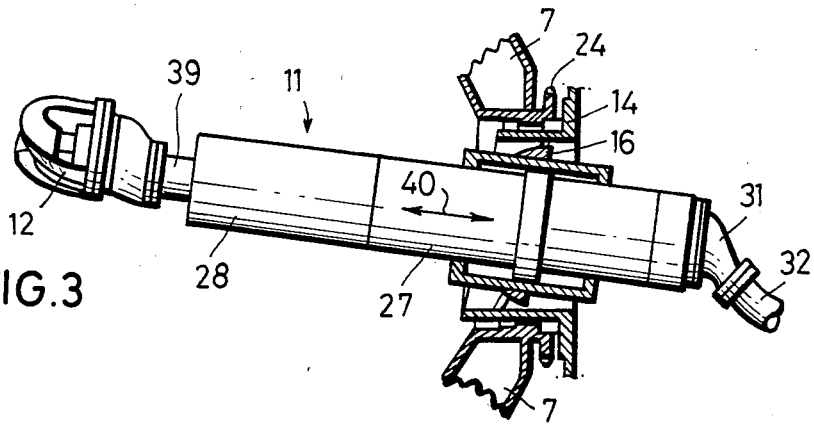
FIG. 3 is a part-sectional view of a modified mounting structure for the cutting arm.

In a modified construction, the arm 11 is also able to extend and retract longitudinally to likewise advance and retract the cutting head 12. FIG. 3 depicts such a modified arrangement wherein the collar 16 is provided on a separate sleeve, which receives the arm 11 for longitudinal motion as indicated by arrows 40. A ring on the arm 11 can serve as a piston and hydraulic pressure fluid can be admitted into working chambers in the sleeve to displace the arm 11. In another construction the output shaft 39 carrying the cutting head 12 is telescopic and hydraulic means can be provided to extend or retract the shaft 39.

In a further modification to the operation of the apparatus as described, the conduit 30 is used in a reverse sense to pass pressure fluid to the face 3 from the pump p to assist in the loosening of the material. The conduit 30 can thus be operated in both suction and pressure modes so that for example when large stones or the like are encountered the conduit 30 would pass the pressure fluid, e.g. water to the face 3 to assist in loosening the bulkier debris.

We claim:

1. In or for a tunnel-driving apparatus having means defining a front chamber open to the working face and separated by a partition from a rear chamber open to the tunnel, with the working face being supported by a supportive fluid filling the front chamber, apparatus for detaching material from said working face and for removing the detached material from said front chamber, said apparatus comprising: a cutting appliance of the partial cut type having a displaceable arm extending forwardly from said rear chamber through said partition into said front chamber; a cutter head at the front end of said arm for detaching material from said face; drive means for driving said cutter head, said drive means being disposed within said arm; conduit means extending within said arms and said drive means from said front chamber through said partition to said rear chamber; and means connected to said conduit means for passing said supportive fluid into said front chamber and for withdrawing a mixture of said supportive fluid and detached material from said front chamber.

2. Apparatus according to claim 1, wherein the conduit means extends coaxially central of the arm.

3. Apparatus according to claim 1, wherein the drive means is composed of a drive motor and gearing.

4. Apparatus according to claim 3, wherein the drive motor is an electric motor.

5. Apparatus according to claim 3, wherein said gearing is planetary gearing.

6. Apparatus according to claim 3, wherein the motor and gearing have housings which form at least part of the arm.

7. Apparatus according to claim 1 further comprising means for mounting said arm on said partition for rotary and swinding motion, said mounting means comprising a ring member rotatably supported on said partition and receiving the arm for pivoting.

8. Apparatus according to claim 7, wherein sealing means extends between the exterior of the ring member and the exterior of the arm.

9. Apparatus according to claim 7, wherein a piston and cylinder unit serves to pivot the arm relative to the ring member.

10. Apparatus according to claim 7, wherein a drive motor supported on the ring member drives a pinion meshing with a toothed wheel fixed to the partition, said motor serving to rotate the ring member and hence the arm.

11. Apparatus according to claim 7, wherein the arm is telescopically extendible and retractible.

12. A tunnel driving apparatus comprising: a shield, a bulkhead within the shield separating a front chamber adjacent a working face from a rear chamber, the working face being supportable by fluid passing into the front chamber, a cutting appliance for acting on said working face, said cutting appliance comprising an arm, means mounting the arm on the bulkhead for rotary and swinging motion, said mounting means also permitting longitudinal displacement of the arm, a cutter head at the end of the arm adjacent the working face, drive means for driving the cutter head, and conduit means for removing material from the front chamber by suction, wherein the drive means and the conduit means are both disposed within the arm.

* * * * *